US007240649B2

(12) United States Patent
Hara et al.

(10) Patent No.: US 7,240,649 B2
(45) Date of Patent: Jul. 10, 2007

(54) VALVE ACTUATION DEVICE OF INTERNAL COMBUSTION ENGINE

(75) Inventors: Seinosuke Hara, Kanagawa (JP); Makoto Nakamura, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/418,199

(22) Filed: May 5, 2006

(65) Prior Publication Data

US 2006/0254546 A1 Nov. 16, 2006

(30) Foreign Application Priority Data

May 10, 2005 (JP) ..... 2005-136943
Feb. 24, 2006 (JP) ..... 2006-047659

(51) Int. Cl.
*F01L 1/34* (2006.01)

(52) U.S. Cl. ..... 123/90.16; 123/90.39; 123/90.44

(58) Field of Classification Search ..... 123/90.16, 123/90.2, 90.39, 90.41, 90.44, 90.6
See application file for complete search history.

(56) References Cited

U.S. PATENT DOCUMENTS 5,988,125 A * 11/1999 Hara et al. ..... 123/90.16
6,055,949 A * 5/2000 Nakamura et al. ..... 123/90.16

FOREIGN PATENT DOCUMENTS

JP 2002-38913 A 2/2002

* cited by examiner

*Primary Examiner*—Ching Chang
(74) *Attorney, Agent, or Firm*—Foley & Lardner LLP

(57) ABSTRACT

A rocker arm is swingably supported by a control shaft that has an eccentric control cam formed thereon. The rocker arm is swung by a torque of a crankshaft of the engine. Two swing cams are swingably supported by a drive shaft and actuate respective engine valves to make an open/close operation of the same by receiving the swinging movement from the rocker arm. The rocker arm comprises a cylindrical base portion through which the control shaft passes; a first projected end that is provided at a first radially outside part of the cylindrical base portion in the vicinity of one axial end of the cylindrical base portion, the first projected end receiving the torque from the crankshaft for carrying out the pivotal movement of the rocker arm; and two second projected ends that are spaced from each other and provided at a second radially outside part of the cylindrical base portion, the second projected ends actuating the two swing cams when the rocker arm is swung. The first and second radially outside parts are opposite with respect to an axis of the cylindrical base portion.

18 Claims, 6 Drawing Sheets

VALVE ACTUATION DEVICE OF INTERNAL COMBUSTION ENGINE

BACKGROUND OF THE INVENTION

1. Field of the Invention

The present invention relates in general to valve actuation devices of an internal combustion engine, and more particularly to valve actuation devices of a type that eliminates or at least minimizes dispersion in a valve lift degree of intake and/or exhaust valves of the engine.

2. Description of the Related Art

In order to clarify the task of the present invention, one known valve actuation device of an internal combustion engine will be briefly described, which is shown in Japanese Laid-open Patent Application (Tokkai) 2002-38913.

The valve actuation device of the publication generally comprises a drive shaft that is synchronously rotated by a crankshaft, an eccentric drive cam that is mounted on the drive shaft, and two swing cams that open and close two intake valves for each cylinder. The two swing cams are rotatably disposed on the drive shaft having the eccentric drive cam put therebetween.

A multi-link type power transmission mechanism is further provided for each cylinder, which swings the two swing cams by receiving a power from the eccentric drive cam.

The multi-link type power transmission mechanism generally comprises a rocker arm that is arranged above an intermediated position of the two swing cams and swingably disposed on a control shaft, a link arm that pivotally connects an end portion of the rocker arm to the eccentric drive cam and a link rod that pivotally connects a forked other end of the rocker arm to each of the swing cams.

The control shaft extends along a longitudinal axis of the engine, and is rotatably supported by bearings that are arranged on an upper part of a cylinder head of the engine. The control shaft has an eccentric control cam for each cylinder, which serves as a swing fulcrum of the rocker arm.

An electric actuator is further provided, which, in accordance with an operation condition of the engine, turns or pivots the control shaft changing an angular position of the control cam, so that the valve lift degree of each intake valve is varied in accordance with the engine operation condition.

The above-mentioned Laid-open Patent Application proposes several types of power transmission mechanism for achieving the above-mentioned function.

SUMMARY OF THE INVENTION

However, due to their inherent constructions, some of the power transmission mechanisms proposed by the above-mentioned Laid-open Patent Application fail to provide a satisfied power transmission function. That is, in one type, a difficulty arises in supporting the drive shaft between the two swing cams, which tends to bring about a poor supporting of the swing cams by the drive shaft and in the other type, another difficulty arises in leveling a cam shaft on which the two swing cams are integrally provided, which tends to bring about an ill-balanced lifting movement of the intake valves.

It is therefore an object of the present invention to provide a valve actuation device of an internal combustion engine, which is free of the above-mentioned drawbacks.

According to the present invention, there is provided a valve actuation device that is constructed to suppress or at least minimize an undesired inclination phenomenon of a rocker arm relative to a control shaft on which the rocker arm is operatively mounted.

According to the present invention, there is further provided a valve actuation device that is constructed to suppress or at least minimize an undesired inclination phenomenon of a drive shaft by which the rocker arm is swung.

According to the present invention, there is still further provided a valve actuation device that is constructed to permit engine valves to have an improved valve lifting operation even in a very small lift mode.

In accordance with a first aspect of the present invention, there is provided a valve actuation device of an internal combustion engine, which comprises a rocker arm swingably supported by a first supporting shaft, the rocker arm being swung by a torque of a crankshaft of the engine; and two swing cams swingably supported by a second supporting shaft, the two swing cams actuating respective engine valves to make an open/close operation of the same by receiving the swinging movement from the rocker arm, wherein the rocker arm comprises a cylindrical base portion through which the first supporting shaft passes; a first projected end that is provided at a first radially outside part of the cylindrical base portion in the vicinity of one axial end of the cylindrical base portion, the first projected end receiving the torque from the crankshaft for carrying out the pivotal movement of the rocker arm; and two second projected ends that are spaced from each other and provided at a second radially outside part of the cylindrical base portion, the second projected ends actuating the two swing cams when the rocker arm is swung, the first and second radially outside parts being opposite with respect to an axis of the cylindrical base portion.

In accordance with a second aspect of the present invention, there is provided a valve actuation device of an internal combustion engine, which comprises a rocker arm swingably supported by a first supporting shaft, the rocker arm being swung by a torque of a crankshaft of the engine; two swing cams swingably supported by a second supporting shaft, the two swing cams actuating respective engine valves to make an open/close operation of the same by receiving the swinging movement from the rocker arm; and a bearing device that is mounted on a cylinder head to bear the second supporting shaft at a position between the two swing cams.

In accordance with a third aspect of the present invention, there is provided a valve actuation device of an internal combustion engine, which comprises a control shaft having an eccentric control cam formed thereon, the control shaft being turned about its axis by a predetermined angle; a rocker arm swingably supported by the eccentric control cam of the control shaft; a drive shaft driven by a crankshaft of the engine, the drive shaft extending in parallel with the control shaft; and two swing cams swingably supported by the drive shaft, the two swing cams actuating respective engine valves to make an open/close operation of the same when receiving the swinging movement from the rocker arm, wherein the rocker arm comprises a cylindrical base portion through which the eccentric control cam of the control shaft passes; a first projected end that is provided at a first radially outside part of the cylindrical base portion in the vicinity of one axial end of the cylindrical base portion, the first projected end receiving the torque from the crankshaft for carrying out the pivotal movement of the rocker arm; and two second projected ends that are spaced from each other and provided at a second radially outside part of the cylindrical base portion, the second projected ends actuating the two swing cams when the rocker arm is swung, the first and second radially outside parts being opposite with respect to an axis of the cylindrical base portion.

Other objects and features of the present invention will become apparent from the following description when taken in conjunction with the accompanying drawings.

DETAILED DESCRIPTION OF THE EMBODIMENTS

In the following, two valve actuation devices 100 and 200, which are first and second embodiments of the present invention, will be described with reference to the accompanying drawings.

For ease of description, various directional terms, such as right, left, upper, lower, rightward and the like, are used in the following explanation. However, such terms are to be understood with respect to only a drawing or drawings on which a corresponding part or portion is shown.

Referring to FIGS. 1 to 4, there is shown a valve actuation device 100 of the first embodiment.

Figure 1:
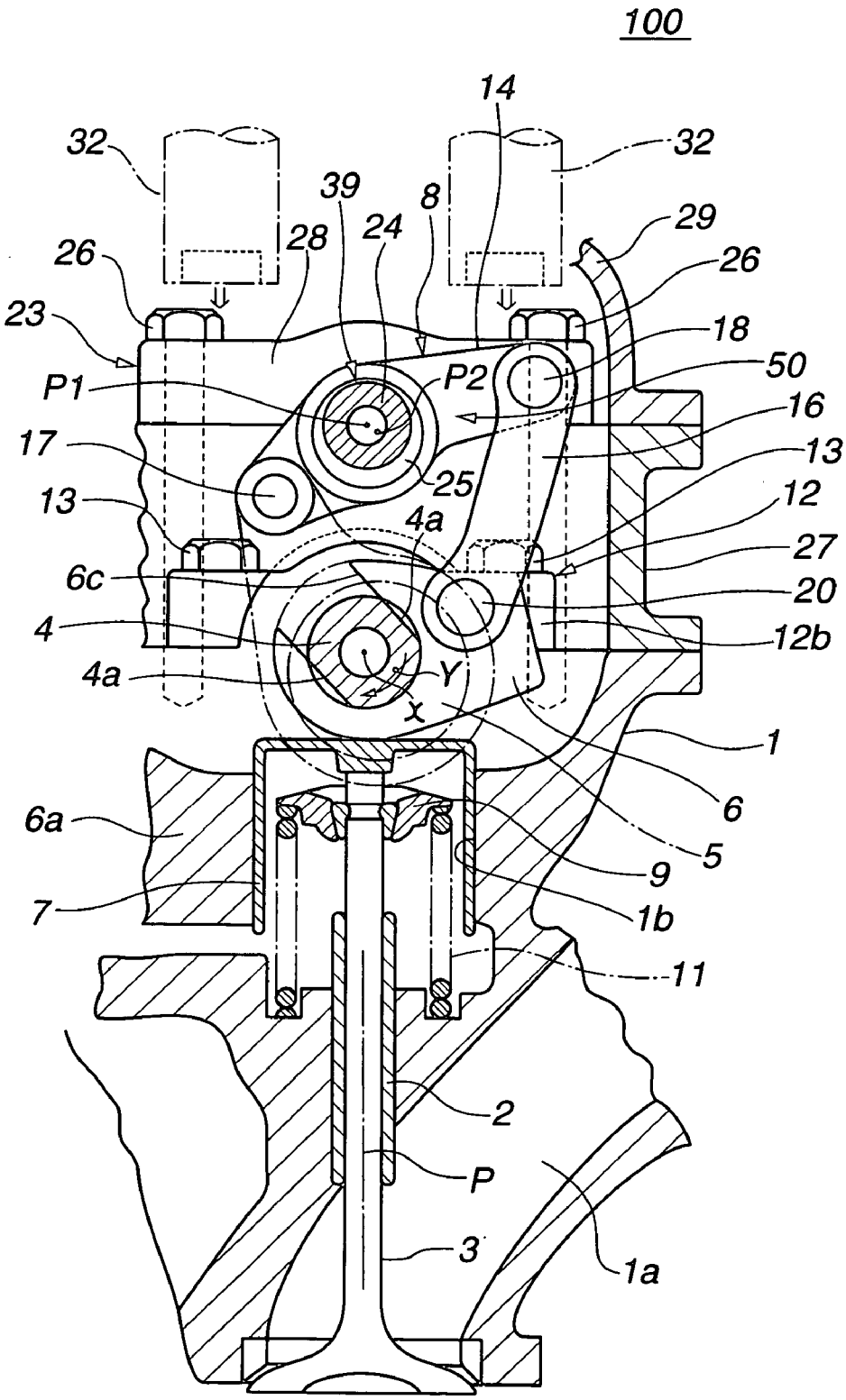
FIG. 1 is a sectional view of a valve actuation device of an internal combustion engine, which is a first embodiment of the present invention.
Figure 3:
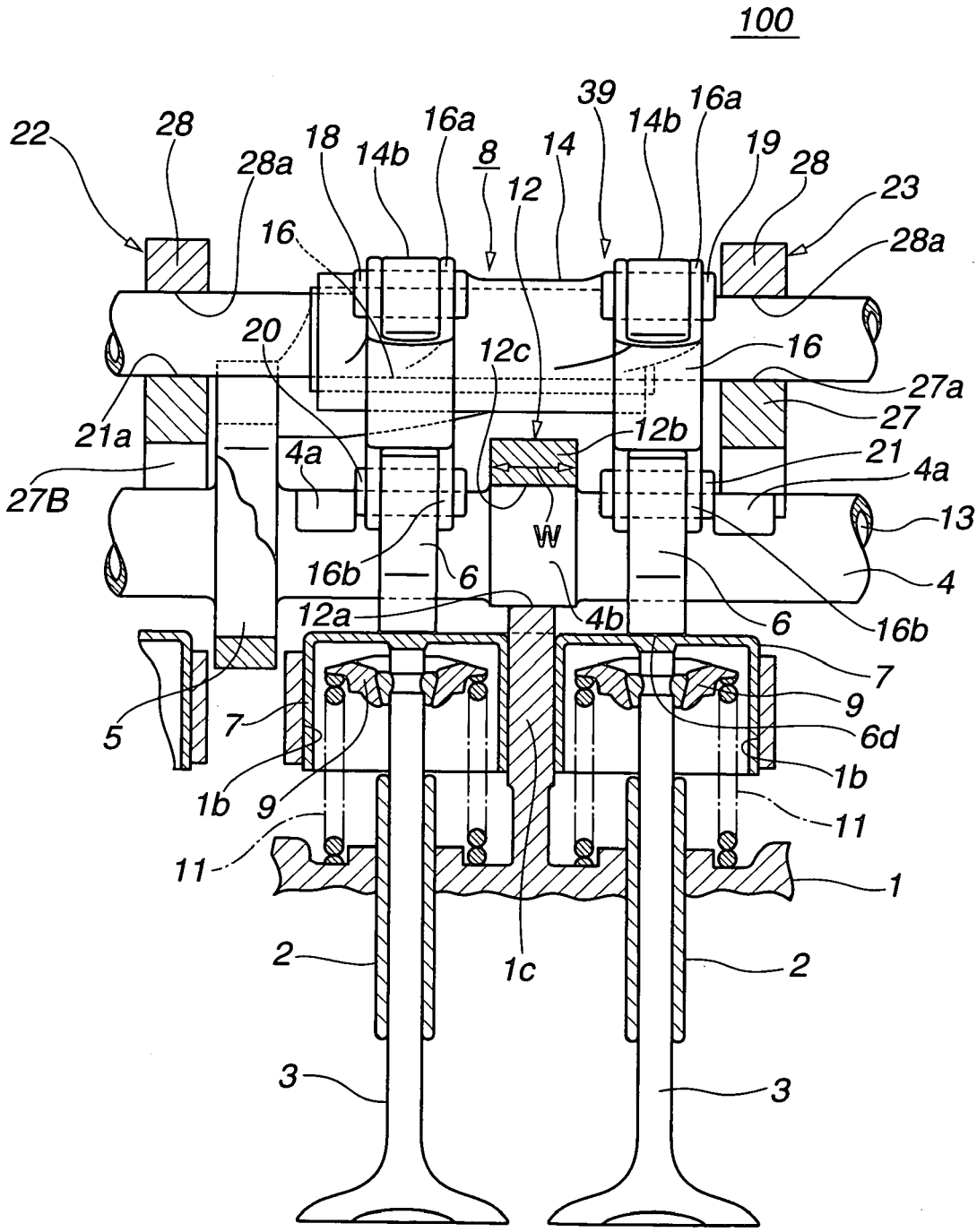
FIG. 3 is a side view of the valve actuation device of the first embodiment.

As will be best seen from FIGS. 1 and 3, valve actuation device 100 is incorporated with a cylinder head 1 of an internal combustion engine. Two intake valves 3 and 3 for each cylinder are slidably connected to cylinder head 1 through respective valve guides 2 and 2.

As is seen from FIG. 1, each intake valve 3 has a circular head that opens and closes an intake port 1*a* formed in cylinder head 1.

As is seen from FIGS. 1 and 3, valve actuation device 100 comprises a hollow drive shaft 4 that is arranged above cylinder head 1 and synchronously driven by a crankshaft (not shown), a drive cam 5 for each cylinder that is integrally formed on drive shaft 4, two swing cams 6 and 6 for each cylinder that open and close respective intake valves 3 and 3 through valve lifters 7 and 7 by receiving a torque from drive shaft 4, and a lift varying mechanism 8 that varies a lift degree/working angle of each intake valve 3 through swing cams 6 and 6.

As is seen from FIG. 1, each intake valve 3 has at a stem end thereof a spring retainer 9. Between spring retainer 9 and a bottom of a bore 1*b* formed in cylinder head 1, there is compressed a valve spring 11, so that intake valve 3 is biased in a closing direction, that is, a direction to close intake port 1*a*.

Drive shaft 4 extends along a longitudinal axis of the engine and is synchronously driven by a crankshaft through a known transmission mechanism. The known transmission mechanism may include a drive sprocket that is fixed to an end of the crankshaft, a driven sprocket that is fixed to an end of drive shaft 4 and a timing chain that is put around both the drive and driven sprockets.

As is seen from FIG. 3, drive shaft 4 is rotatably held by a first bearing device 12 that is arranged on the upper part of cylinder head 1 at a position between the two swing cams 6 and 6.

As is seen from FIG. 1, in operation, drive shaft 4 is permitted to rotate in only one direction as shown by an arrow. As shown in this drawing, drive shaft 4 is positioned just above the intake valves 3 and 3. That is, an axis P of each intake valve 3 intersects an axis x of drive shaft 4 at right angles. Drive shaft 4 is formed with an axially extending oil passage that is connected to a main oil gallery (not shown).

Figure 2:
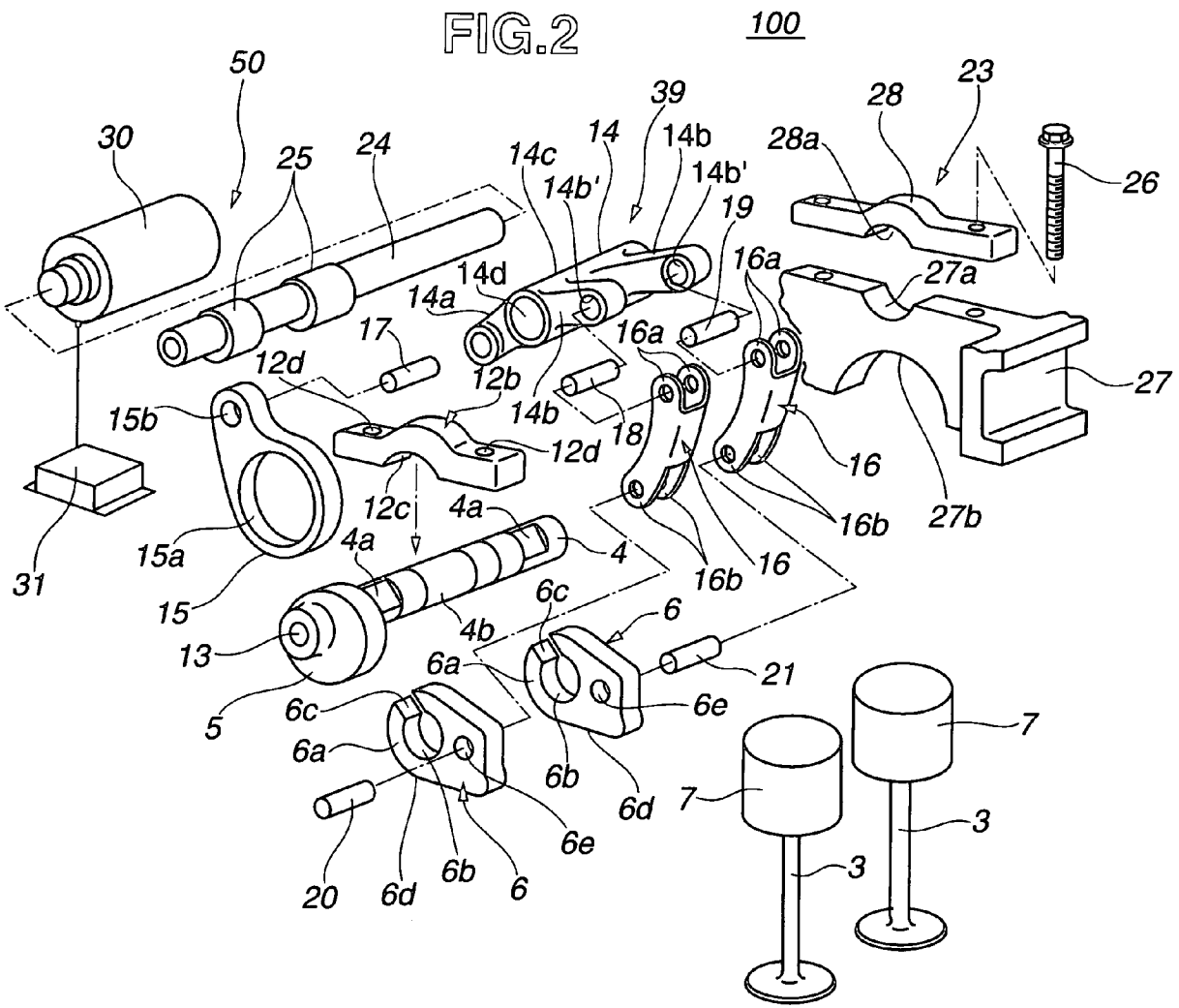
FIG. 2 is an exploded perspective view of the valve actuation device of the first embodiment.

As is seen from FIGS. 1 and 2, particularly from FIG. 2, drive shaft 4 is formed at longitudinally end portions thereof with diametrically thinner portions each including diametrically opposed recesses 4*a* and 4*a*. More specifically, bottoms of these opposed recesses 4*a* and 4*a* are flat and parallel with each other.

As is seen from FIG. 3, such diametrically thinner portions (4*a*) are positioned outside of the corresponding swing cams 6 and 6.

Referring back to FIG. 2, drive cam 5 has a thicker circular shape and is integrally mounted on one end of drive shaft 4 in a manner to be eccentric with respect to the axis of drive shaft 4. That is, drive cam 5 is of an eccentric type with respect to drive shaft 4. More specifically, as is seen from FIG. 1, an axis "y" of drive cam 5 is offset relative to the axis "x" of drive shaft 4.

As is understood from FIGS. 1 and 2, each swing cam 6 is shaped like a raindrop, comprising a base portion 6*a* that has at its center position a circular opening 6*b* through which drive shaft 4 passes. Base portion 6*a* has further an insert slot 6*c* that extends radially outward from circular opening 6*b*. That is, in case of coupling drive shaft 4 with swing cams 6 and 6, insert slots 6*c* of the swing cams 6 and 6 receive the diametrically thinner portions (4*a*) of drive shaft 4 for guiding drive shaft 4 to circular openings 6*b* and 6*b*.

Furthermore, each swing cam 6 is formed with a cam surface 6*d* at a lower side thereof. Cam surface 6*d* generally comprises a basic round surface that is possessed by the base portion 6*a*, a ramp surface that extends roundly from the basic round surface toward a cam nose side and a lift surface that extends from the ramp surface to a maximally raised part possessed by the cam nose side. That is, depending on an angular position taken by swing cam 6, the basic round surface, the ramp surface, the lift surface and the maximally raised part contact successively a given upper surface of the corresponding valve lifter 7. As shown, the cam nose side has a pin bore 6*e* formed therethrough.

As is seen from FIGS. 1 to 3, each valve lifter 7 has a cylindrical cap (no numeral) put on the stem end of intake valve 3. The cylindrical cap is slidably received in bore 1*b* formed in cylinder head 1.

Figure 4:
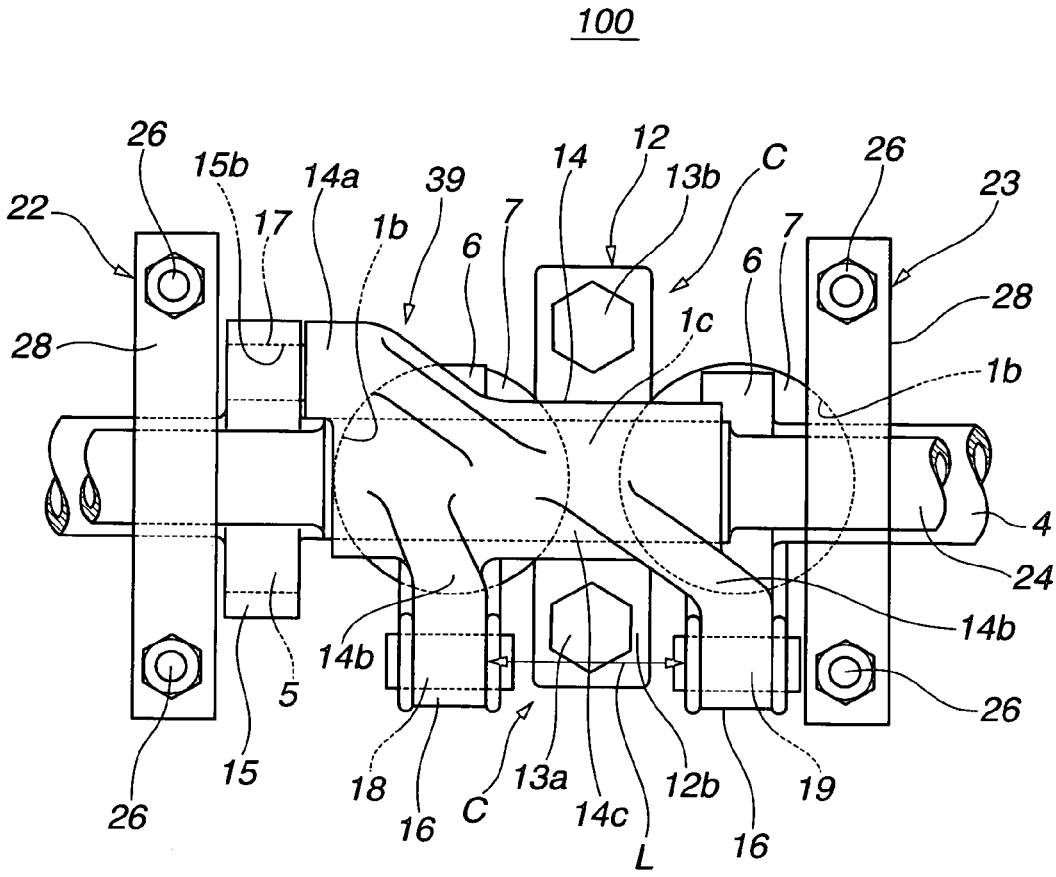
FIG. 4 is a plan view of the valve actuation device of the first embodiment.

As is seen from FIGS. 2 to 4, particularly FIG. 3, the above-mentioned first bearing device 12 comprises a rounded recess 12*a* that is formed on an upper surface of a partition wall 1*c* of cylinder head 1 that is positioned between paired bores 1*b* and 1*b*, and a first bearing bracket 12*b*. As is seen from FIG. 2, first bearing bracket 12*b* is formed with a rounded recess 12*c* that is to be mated with rounded recess 12*a* of partition wall 1*c* to rotatably support a journal portion 4*b* of drive shaft 4.

As will be understood from FIGS. 2 and 4, upon assembly, first bearing bracket 12*b* is secured to the upper surface of the partition wall 1*c* of cylinder head 1 by means of two bolts 13*a* and 13*b* that pass through bolt openings 12*d* and 12*d* of first bearing bracket 12*b* (see FIG. 2). For this securing by bolts 13*a* and 13*a*, the upper surface of partition wall 1*c* is formed with threaded bolt holes with which leading threaded ends of bolts 13*a* and 13*a* are engaged.

As is seen from FIG. 4, one bolt 13*a* is positioned between united two arm portions 14*b* and 14*b* of an after-mentioned rocker arm 14, and the other bolt 13*b* is positioned at a position opposite to the bolt 13*a* with respect to drive shaft 4. That is, these two bolts 13*a* and 13*b* are arranged symmetrically with respect to the axis of drive shaft 4.

As will be understood from FIGS. 2 and 3, upon assembly of first bearing device 12, journal portion 4*b* of drive shaft 4 is rotatably supported by a cylindrical inner surface that includes the above-mentioned rounded recesses 12*c* and 12*a*.

As is seen from FIGS. 3 and 4, the width "W" of first bearing bracket 12*b* is larger than the thickness of a thinnest part of partition wall 1*c* of cylinder head 1.

As will be understood from FIGS. 1 and 4, above the two bolts 13*a* and 13*b*, there are defined two spaces "C" and "C" that are produced by a unique configuration of the united two arm portions 14*b* and 14*b* of the rocker arm 14, through which a given tool, such as a wrench 32 (see FIG. 1) or the like, is insertable.

The above-mentioned lift varying mechanism 8 comprises a power transmission section 39 that transmits a torque of drive cam 5 to swing cams 6 and 6 and an attitude control section 50 that controls or varies an operation attitude of power transmission section 39 in accordance with an operation condition of the engine.

As is seen from FIGS. 2 and 3, power transmission section 39 comprises rocker arm 14 that is positioned above drive shaft 4, a ring arm 15 that links one projected end 14*a* of rocker arm 14 to drive cam 5, and a pair of link rods 16 and 16 that pivotally connect the united two arm portions 14*b* and 14*b* of rocker arm 14 to the paired swing cams 6 and 6.

The power transmission section 39 having the above-mentioned construction is classified to a desmo-type, and an after-mentioned power transmission section 39' employed in a second embodiment 200 is classified to a non-desmo-type.

Referring back to FIG. 2 that shows the first embodiment 100, rocker arm 14 comprises a cylindrical base portion 14*c* that has a through bore 14*d* in which after-mentioned control cams 25 and 25 are operatively received. That is, rocker arm 14 is rotatably supported by after-mentioned control cams 25 and 25. These control cams 25 and 25 are integrally formed on a control shaft 24.

As is seen from FIG. 4, projected end 14*a* of rocker arm 14 is projected from cylindrical base portion 14*c* in a direction away from the united two arm portions 14*b* and 14*b*. A pin 17 extending from projected end 14*a* inserts into a pin hole 15*b* provided in one end of ring arm 15.

Thus, as is understood from FIG. 4, pin 17 received in pin hole 15*b* of ring arm 15 serves as a first support point for rocker arm 14.

As will be described in detail hereinafter, the united two arm portions 14*b* and 14*b* of rocker arm 14 are pivotally connected to link rods 16 and 16 through respective pins 18 and 19. For this pivotal connection, each pin 18 or 19 passes through both a pin hole 16*a* of link rod 16 and a pin hole 14*b'* of arm portion 14*b* which are aligned. As shown in FIG. 2, pin hole 16*a* is provided in a forked upper end of each link rod 16.

Thus, each of the pins 18 and 19 received in pin holes 16*a* and 16*a* of link rods 16 and 16 serves as a second support point for rocker arm 14.

As will be understood from FIGS. 1 and 2, upon assembly, the above-mentioned first and second support points for rocker arm 14 are arranged at radially opposite positions with respect to control shaft 24.

As is seen from FIG. 4, the shorter one of the united two arm portions 14*b* and 14*b* of rocker arm 14 comprises a shorter base portion that extends diagonally from an axially end portion of cylindrical base portion 14*c* of rocker arm 14 and a leading portion that extends outward from the shorter base portion in a direction perpendicular to an axis of the cylindrical base portion 14*c*, while the longer one of the united two arm portions 14*b* and 14*b* comprises a longer base portion that extends diagonally from an axially middle portion of cylindrical base portion 14*c* and a leading portion that extends outward from the longer base portion in a direction perpendicular to the axis of the cylindrical base portion 14*c*.

Thus, as will be understood from FIG. 4, the leading portions of the two united two arm portions 14*b* and 14*b* are arranged to put therebetween a certain distance "L". As has been mentioned hereinabove, pins 18 and 19 are used for pivotally connecting the leading portions of the united two arm portions 14*b* and 14*b* of rocker arm 14 to link rods 16 and 16.

As is best understood from FIG. 2, the above-mentioned ring arm 15 comprises a larger ring portion that has a circular opening 15*a* and a lug portion that is raised from a part of the larger ringer portion and has the above-mentioned pin hole 15*b*. That is, circular opening 15*a* is rotatably received on drive cam 5 of drive shaft 4. The larger ring portion is slightly thicker than drive cam 5 for assuring the rotatable connection of drive cam 5 with the circular opening 15*a*. As has been mentioned hereinabove, the pin hole 15*b* of the lug portion receives pin 17 that extends from projected end 14*a* of rocker arm 14.

As is seen from FIG. 2, link rods 16 and 16 are produced by pressing a metal sheet and have a generally U-shaped cross section. Each end of each link rod 16 has two spaced lugs 16*a* and 16*a* (or, 16*b* and 16*b*). Spaced lugs 16*a* and 16*a* of each link rod 16 put therebetween the leading end of the corresponding arm portion 14*b* of rocker arm 14 and the other spaced lugs 16*b* and 16*b* of each link rod 16 put therebetween and the nose portion of the corresponding swing cam 6. Two pins 18 and 19 are used for achieving the pivotal connection between each link rod 16 and arm portions 14*b* and 14*b*, as is mentioned hereinabove. Two pins 20 and 21 are used for achieving a pivotal connection between each link rod 16 and swing cams 6 and 6. For this pivotal connection with pins 20 and 21, each swing cam 6 has a pin hole 6*e* and 6*e* formed therethrough, as shown.

As is seen understood from FIGS. 1, 2 and 3, the above-mentioned attitude control section 50 of lift varying mechanism 8 comprises the control shaft 24 (see FIG. 3) that is rotatably supported by two second bearing devices 22 and 23 arranged at both sides of rocker arm 14, and the identical control cams 25 and 25 (see FIG. 2) that are integrally formed on control shaft 24. As has been mentioned hereinabove, control cams 25 and 25 serve as a swing fulcrum of rocker arm 14.

As is seen from FIGS. 3 and 4, particularly from FIG. 4, one 22 of second bearing devices 22 and 23 is placed, when viewed from the above, at a position axially outside of projected end 14*a* of rocker arm 14, and the other 23 of second bearing devices 22 and 23 is placed, when viewed from the above, at a position outside of the longer one of two arm portions 14*b* and 14*b* of rocker arm 14. Each bearing device 22 or 23 is fixed to upper portions of cylinder head 1 by means of paired bolts 26 and 26.

As is understood from FIG. 2, each bearing device 23 or 22 comprises a frame-like lower bracket (or carrier bracket) 27 that has an up-faced rounded recess 27*a*, a bridge like upper bracket 28 that has a down-faced rounded recess 28*a* and the above-mentioned paired bolts 26 by which lower and upper brackets 27 and 28 are secured to cylinder head 1. Upon assembly, the two rounded recesses 27*a* and 28*a* are mated to constitute a cylindrical wall for bearing control shaft 24.

As is seen from FIG. 2, frame-like lower bracket 27 is formed with a down-faced rounded recess 27*b* that is larger than the upper rounded recess 27*a*. That is, due to provision of down-faced larger rounded recess 27*b* that serves as a clearance groove, drive shaft 4 is permitted to take a place below the bracket 27.

As is understood from FIG. 1, a head cover 29 of the engine is put on the carrier brackets 27 at its lower flange.

As is understood from FIG. 2, control shaft 24 extends in parallel with drive shaft 4, that is, along the longitudinal axis of the engine. As shown, control shaft 24 is driven by an electric actuator 30 through a reduction gear device. That is, an angular position of control shaft 24 is varied by actuator 30. Control cams 25 and 25 integral with control shaft 24 may be united to constitute a single and thus longer control cam. However, for achieving a light weight construction, a two piece construction for the cam 25 is employed in the disclosed embodiment. Due to the nature of control cams 25, a rotation axis P2 thereof is offset from that P1 of control shaft 24, as shown in FIG. 1.

As is seen from FIG. 2, an electronic controller 31 is provided for controlling operation of electric actuator 30 in accordance with the operation condition of the engine. The controller 31 has a microcomputer installed therein. That is, by processing information signals from a crank angle sensor that detects the crank angle of the engine, an air flow meter that detects the amount of air fed to the engine, a water temperature sensor that detects the temperature of the engine cooling water, an angular position sensor that detects the angular position of control shaft 24 and other sensors, the controller 31 detects a current operation condition of the engine, and based on this detected current operation condition, the controller 31 controls electric actuator 30 and thus controls the lift degree/working angle of intake valves 3 of the engine.

In the following, operation of valve actuation device 100 of the first embodiment will be described with reference to FIGS. 1 and 2.

For ease of description, the description will be commenced with respect to a high-lift condition as shown in FIG. 1 wherein the thickest portion of each control cam 25 on control shaft 24 is directed downward.

When, upon processing the information signals from the various sensors, electronic controller 31 issues an instruction signal for providing intake valves 3 and 3 with a smaller lift degree, electric actuator 30 turns control shaft 24 in a counterclockwise direction in FIG. 1 by a certain angle, that is, by about 90 degrees for example. Upon this, as is understood from FIG. 1, each control cam 25 is turned to and stays at an angular position wherein the thickest portion thereof takes a right position with respect to control shaft 24. With this, the rotation axis P2 of control cam 25 is moved upward relative to the above-mentioned original position of FIG. 1.

Thus, as is understood from FIGS. 1 and 2, the united two arm portions 14*b* and 14*b* of rocker arm 14 are shifted upward, and thus, the cam nose sides of swing cams 6 and 6 are enforcedly shifted up through link rods 16 and 16.

Accordingly, as will be understood from FIG. 1, the degree by which each swing cam 6 pushes down the corresponding valve lifter 7 becomes small, which brings about a smaller lift degree of each intake valve 3.

When, thus, under such condition of control cams 25 and 25, ring arm 15 provides rocker arm 14 with a pivotal movement due to rotation of drive cam 5 of drive shaft 4, the open/close operation of each intake valve 3 is carried out with a smaller lift degree. This means a retarded open timing of intake valves 3 and 3 shortening an overlap period with exhaust valves.

As is known, such operation mode with a smaller lift degree of intake valves 3 and 3 brings about a stable operation of the engine with an improved fuel consumption in a low load range of the engine.

While, when electronic controller 31 issues an instruction signal for providing intake valves 3 and 3 with a larger lift degree, electric actuator 30 turns control shaft 24 in a clockwise direction in FIG. 1 by a certain angle. Upon this, each control cam 25 is turned to and stays at the angular position of FIG. 1 wherein the thickest portion of each control cam 25 takes a lower position with respect to control shaft 24. With this, the rotation axis P2 of control cam 25 is moved downward relative to the above-mentioned upper position.

Thus, as is understood from FIGS. 1 and 2, the united two arm portions 14*b* and 14*b* of rocker arm 14 are shifted downward, and thus, the cam nose sides of swing cams 6 and 6 are enforcedly shifted down through link rods 16 and 16.

Thus, as will be understood from FIG. 1, the degree by which each swing cam 6 pushes down the corresponding valve lifter 7 becomes large, which brings about a larger lift degree of each intake valve 3.

When, thus, under such condition of control cams 25 and 25, ring arm 15 provides rocker arm 14 with a pivotal movement due to rotation of drive cam 5 of drive shaft 4, the open/close operation of each intake valve 3 is carried out with a larger lift degree. This means an advanced open timing of intake valves 3 and a retarded close timing of the same. As is known, such operation mode with a larger lift degree of intake valves 3 and 3 brings about a sufficient output of the engine due to a sufficient air charging efficiency in a higher load range of the engine.

As has been mentioned hereinabove and is best understood from FIG. 4, in the first embodiment 100, projected end 14*a* of rocker arm 14 is projected from cylindrical base portion 14*c* in a direction away from the united two arm portions 14*b* and 14*b*, and each of the shorter and longer arm portions 14*b* and 14*b* of rocker arm 14 comprises a base portion that extends diagonally from the cylindrical base portion 14*c* and a leading portion that extends outward from the base portion in a direction perpendicular to the axis of the cylindrical base portion 14*c*.

Accordingly, the power transmission from drive cam 5 to swing cams 6 and 6 through projected end 14*a*, cylindrical base portion 14*c* and two arm portions 14*b* and 14*b* can be smoothly made. More specifically, the two arm portions 14*b* and 14*b* of rocker arm 14 can stably receive not only the power from drive shaft 4 but also from a force produced by valve springs 11 and 11.

Thus, undesired inclination phenomenon of rocker arm 14 under operation of the engine is suppressed, and thus, the control of the valve lift degree of intake valves 3 and 3 by the lift varying mechanism 8 is assuredly and precisely carried out.

Figure 5:
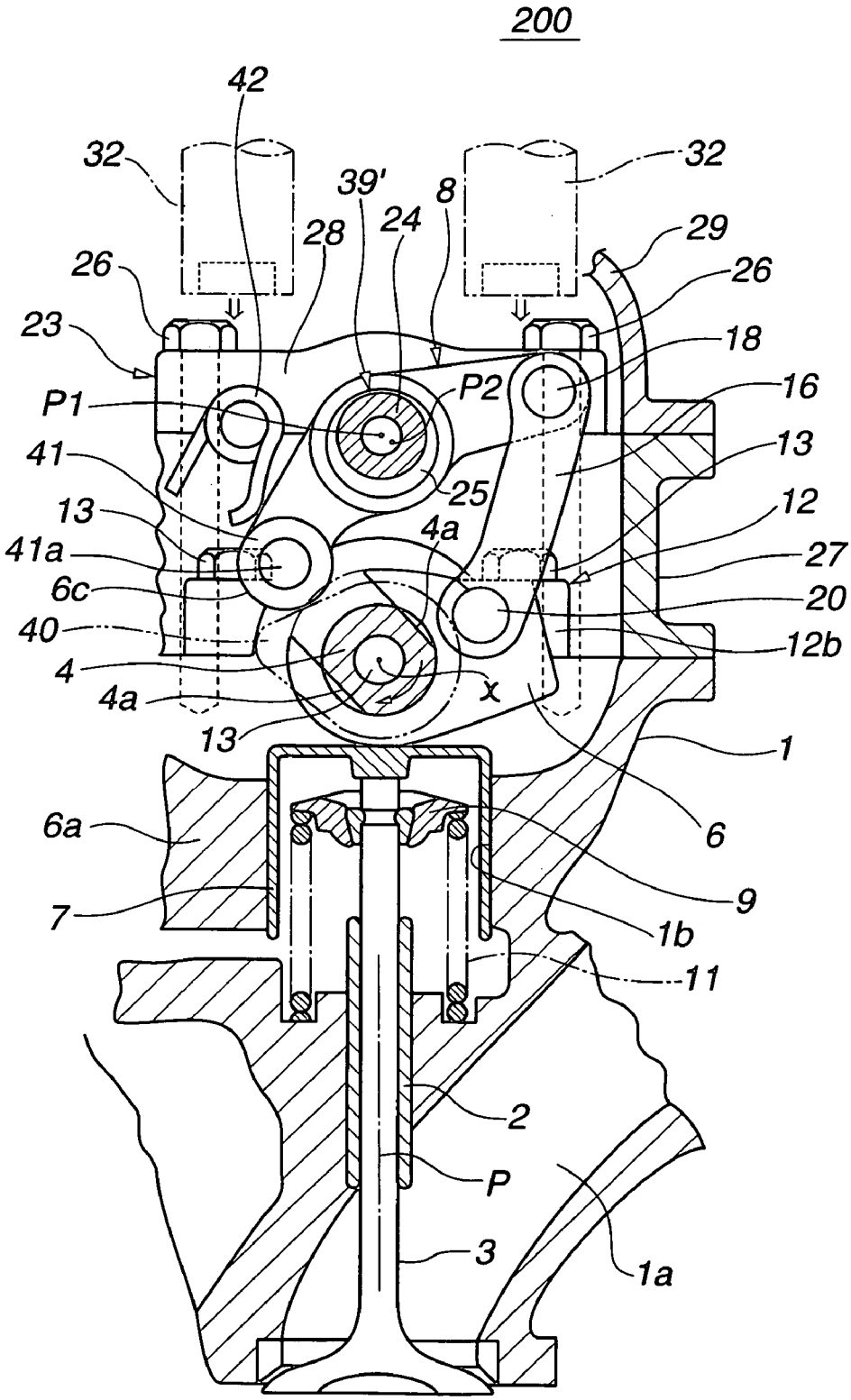
FIG. 5 is a sectional view of a valve actuation device of an internal combustion engine, which is a second embodiment of the present invention.
Figure 6:
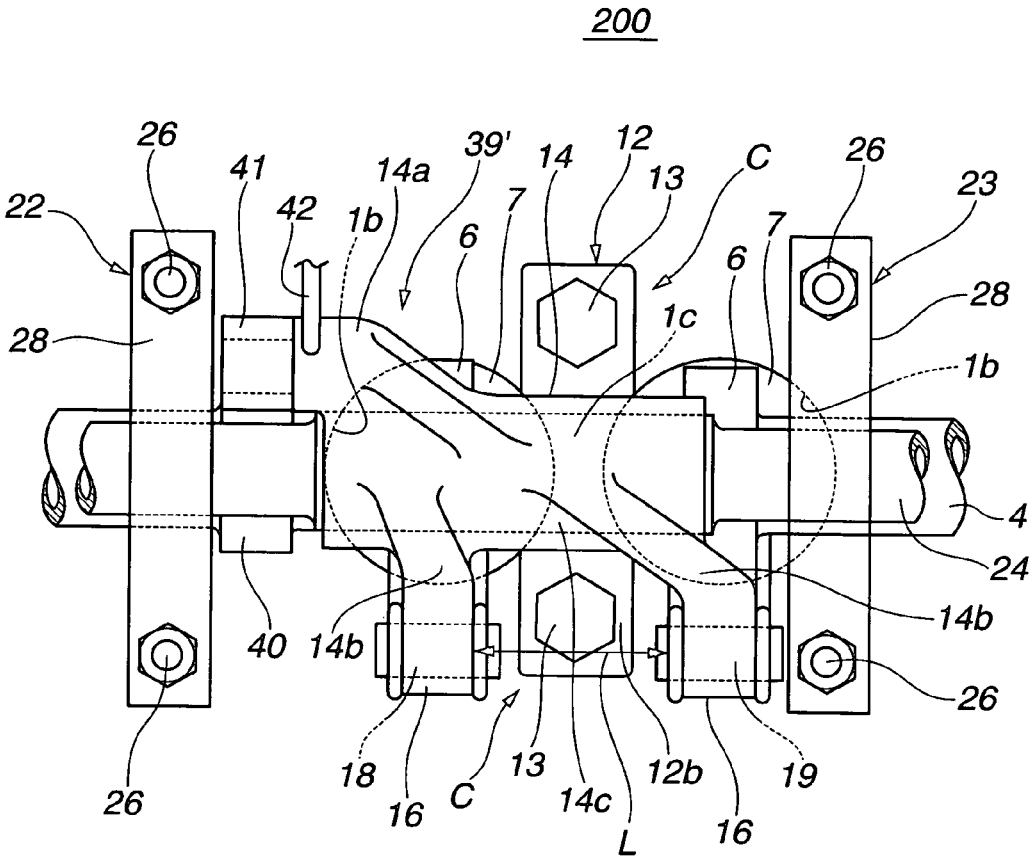
FIG. 6 is a plan view of the valve actuation device of the second embodiment.

Referring to FIGS. 5 and 6, there is shown a valve actuation device 200 which is the second embodiment of the present invention.

Since valve actuation device 200 of this second embodiment is similar in construction to the above-mentioned device 100 of the first embodiment, only portions and parts that are different from those of the first embodiment 100 will be described in detail in the following for simplification of description. Substantially same parts and portions as those of the first embodiment 100 are denoted by the same numerals.

As is understood from FIGS. 5 and 6, in place of power transmission section 39 of the first embodiment 100 that uses the ring arm 15 for operatively connecting drive cam 5 and rocker arm 14, this second embodiment 200 employs another type power transmission section 39' that will be described in detail in the following.

As is seen from FIGS. 5 and 6, in this second embodiment 200, the power transmission section 39' comprises an oval drive cam 40 that is integrally formed on drive shaft 4, and a roller 41 that is rotatably connected to projected end 14*a* of rocker arm 14 and operatively put on a cam surface of oval drive cam 40. A return spring 42 is used for biasing roller 41 against the cam surface of drive cam 40.

As has been mentioned hereinabove, the power transmission section 39' having the above-mentioned construction is classified to a non-desmo type.

More specifically, oval drive cam 40 comprises a base circle part and a lift part. The drive cam 40 has a center bore through in which a part of drive shaft 4 is tightly received. Roller 41 is rotatably disposed on a roller shaft 41*a* that is provided on projected end 14*a* of rocker arm 14. Return spring 42 has one end fitted to second bearing device 23 and the other end pressed against a back side of projected end 14*a* of rocker arm 14, as shown in FIG. 5.

Thus, roller 41 serves as a first support point for rocker arm 14, and like in the above-mentioned first embodiment 100, each of the pins 18 and 19 received in pin holes 16*a* and 16*a* of link rods 16 and 16 serves as a second support point for rocker arm 14.

Like in the first embodiment 100, upon assembly, the first and second support points for rocker arm 14 are arranged at radially opposite positions with respect to control shaft 24.

The torque of drive cam 5 is transmitted to rocker cam 14 through roller 41 that is arranged at projected end 14*a* to serve as the first support point for rocker arm 14, and at a side opposite to the roller 41 with respect to control shaft 24, there is arranged a connection between rocker arm 14 and swing cams 6 and 6, which serves as the second support point for rocker arm 14.

In this second embodiment 200, only when a valve lifting of intake valves 3 and 3 takes place, rocker arm 14 having the first and second support points is swung by oval drive cam 40. That is, when roller 41 is in contact with the base circle part of oval drive cam 40, rocker arm 14 does not swing. Thus, the swing angle of rocker arm 14 can be made relatively small, which brings about a compact construction of the power transmission section 39' including oval drive cam 40. As is known, compactness of power transmission section 39' facilitates mounting of the same onto cylinder head 1.

Due to compactness of power transmission section 39' particularly at the portion around oval drive cam 40, layout of parts in the dead space defined between adjacent cylinders can be made with ease.

Even if rocker arm 14 is enlarged in size, oval drive cam 40 and roller 41 that are relative small in size can be easily installed in proper positions because of compactness around drive cam 40 that the non-desmo type inherently has. This promotes the easy mounting of power transmission section 39' onto cylinder head 1.

In the following, operation of valve actuation device 200 of the second embodiment will be described with reference to FIGS. 5 and 2.

For ease of description, the description will be commenced with respect to a high-lift condition as shown in FIG. 5 wherein the thickest portion of each control cam 25 on control shaft 24 is directed downward.

When, upon processing the information signals from the various sensors, electronic controller 31 (see FIG. 2) issues an instruction signal for providing intake valves 3 and 3 with a smaller lift degree, electric actuator 30 (see FIG. 2) turns control shaft 24 in a counterclockwise direction in FIG. 5 by a certain angle, that is, by about 90 degrees for example. Upon this, as is understood from FIG. 5, each control cam is turned to and stays at an angular position wherein the thickest portion thereof takes a right position with respect to control shaft 24. With this, the rotation axis P2 of control cam 25 is moved upward relative to the above-mentioned original position of FIG. 5.

Thus, as is understood from FIGS. 5 and 2, the united two arm portions 14*b* and 14*b* of rocker arm 14 are shifted upward, and thus, the cam nose sides of swing cams 6 and 6 are enforcedly shifted up through link rods 16 and 16.

Accordingly, as will be understood from FIG. 5, the degree by which each swing cam 6 pushes down the corresponding valve lifter 7 becomes small, which brings about a smaller lift degree of each intake valve 3.

Thus, when, under such condition of control cams 25 and 25, roller 41 provides rocker arm 14 with a pivotal movement due to rotation of oval drive cam 40, the open/close operation of each intake valve 3 is carried out with a smaller lift degree. This means a retarded open timing of intake valves 3 and 3 shortening an overlap period with exhaust valves.

While, when electric controller 31 issues an instruction signal for providing intake valves 3 and 3 with a larger lift degree, electric actuator 30 turns control shaft 24 in a clockwise direction in FIG. 5 by a certain degree. Upon this, each control cam 25 is turned to and stays at the angular position of FIG. 5 wherein the thickest portion of each control cam 25 takes a lower position with respect to control shaft 24. With this, the rotation axis P2 of control cam 25 is moved downward relative to the above-mentioned upper position.

Thus, the united two arm portions 14*b* and 14*b* of rocker arm 14 are shifted downward, and thus, the cam nose sides of swing cams 6 and 6 are enforcedly shifted down through link rods 16 and 16.

Thus, the degree by which each swing cam 6 pushes down the corresponding valve lifter 7 becomes large, which brings about a larger lift degree of each intake valve 3.

When, thus, under such condition of control cams 25 an 25, roller 41 provides rocker arm 14 with a pivotal movement due to rotation of oval drive cam 40 of drive shaft 4, the open/close operation of each intake valve 3 is carried out with a larger lift degree.

As is seen from FIG. 5, due to provision of return spring 42 that constantly biases rocker arm 14 in a counterclockwise direction, roller 41 is forced to constantly contact the cam surface of oval drive cam 40 even when the drive cam 40 is under rotation. The constant contact between roller 41 and drive cam 40 produces no collision therebetween and thus produces no noises collision noise. Furthermore, due to the work of return spring 42, the swing movement of swing cams 6 and 6 is assuredly made. By placing the one end of return spring 42 by which rocker arm 14 is pressed near roller 42, the spring force of return spring 42 applied to control cams 25 and 25 is reduced, and thus, the torque for rotating control cams 25 and 25 can be sufficiently reduced, which brings about a compact construction of the actuator.

Furthermore, also in this second embodiment 200, projected end 14*a* of rocker arm 14 is projected from cylindrical base portion 14*c* in a direction away from the united two arm portions 14*b* and 14*b*, and each of the shorter and longer arm portions 14*b* and 14*b* of rocker arm 14 comprises a base portion that extends diagonally from the cylindrical base portion 14*c* and a leading portion that extends outward from the base portion in a direction perpendicularly to the axis of cylindrical base portion 14*c*.

Accordingly, the power transmission from drive cam 5 to swing cams 6 and 6 through projected end 14*a*, cylindrical base portion 14*c* and two arm portions 14*b* and 14*b* can be smoothly made. More specifically, the two arm portions 14*b* and 14*b* of rocker arm 14 can stably receive not only the power from drive shaft 4 but also from a force produced by valve springs 11 and 11.

Thus, undesired inclination phenomenon of rocker arm 14 under operation of the engine is suppressed, and thus, the control of the valve lift degree of intake valves 3 and 3 by the lift varying mechanism 8 is assuredly and precisely carried out.

In the following, various advantages that are commonly possessed by the above-mentioned first and second embodiments 100 and 200 will be described.

First, as is seen from FIGS. 3, 4 and 6, due to the above-mentioned unique shape and arrangement of rocker arm 14 that is featured by projected end 14*a* and two arm portions 14*b* and 14*b*, first bearing device 12 can be easily arranged between the two swing cams 6 and 6 and as is seen from FIGS. 4 and 6, there can be produced sufficient spaces C and C above the bolts 13*a* and 13*b*. Thus, as is understood from FIGS. 1 and 5, a given tool, such as wrench 32 or the like, is easily insertable into a desired position through the sufficient spaces C and C for fastening or unfastening bolts 13*a* and 13*b*. That is, due to the unique shape of rocker arm 14 that is shaped to provide the sufficient spaces C and C, first bearing device 12 can be easily fixed to a desired position. Because of provision of first bearing device 12, the supporting stiffness for drive shaft 4 is increased. Thus, even if an abnormally big load is applied to drive shaft 4 through swing cams 6 and 6 under operation of the engine, undesired deformation of drive shaft 4 is suppressed.

Since, as is seen from FIG. 3, the width "W" of first bearing bracket 12*b* is made larger than the thickness of the thinnest part of partition wall 1*c* of cylinder head 1, the supporting of drive shaft 4 by first bearing device 12 is assuredly made even if the adjacent valve lifters 7 and 7 are positioned close to each other. This brings about a reduction in longitudinal length of the engine, and thus a compact construction of the same.

As is seen from FIG. 2, opposed recesses 4*a* and 4*a* of drive shaft 4 and insert slots 6*c* and 6*c* of swing cams 6 and 6 bring about an easy and quick mounting of swing cams 6 and 6 onto given portions of drive shaft 4. Actually, after insertion of the portions of the opposed recesses 4*a* and 4*a* into circular openings 6*b* and 6*b*, swing cams 6 and 6 are moved on drive shaft 4 toward each other.

In the above-mentioned first embodiment 100, drive cam 5 is integral with drive shaft 4, which means an assured connection therebetween.

As is understood from FIG. 2, in both first and second embodiments 100 and 200, each of swing cams 6 and 6 can be made flat in shape. This means easy and economical production of swing cams 6 and 6.

Since insert slot 6*c* of each swing cam 6 is provided at a portion other than the cam surface 6*d*, the force produced by valve spring 11 (see FIG. 1) of valve lifter 7 is not applied to such insert slot 6*c*. Accordingly, undesired wearing of drive shaft 4, which would be caused by stress concentration at such insert slot 6*c*, is suppressed.

Once swing cams 6 and 6 are properly mounted to proper positions of drive shaft 4, the proper positioning of swing cams 6 and 6 is kept by the respective link rods 16 and 16. That is, undesired movement of each swing cam 6 toward the opposed recesses 4*a* and 4*a* is suppressed.

By continuously turning control shaft 24, namely, control cams 25 and 25 on control shaft 24, the actual swing fulcrum of rocker arm 14 is continuously changed in position and thus the lift degree of intake valves 3 and 3 is continuously varied. Because of integral connection of the one projected end 14*a* and two arm portions 14*b* and 14*b* with rocker arm 14, transmission of the pivotal movement of rocker cam 14 to swing cams 6 and 6 through link rods 16 and 16 is carried out with an improved synchronization. Thus, dispersion in a valve lift degree of intake valves 3 and 3 can be minimized particularly in a small lift operation mode of the engine.

In the afore-mentioned two embodiments 100 and 200, the explanation is directed to the valve actuation device for actuating intake valves 3 and 3. However, if desired, the present invention may be applied to a valve actuation device for actuating exhaust valves.

Furthermore, the concept of the present invention may be applied to a valve actuation device that uses arms or swing arms in place of the above-mentioned valve lifters 7 and 7.

The entire contents of Japanese Patent Application 2005-136943 filed May 10, 2005 and Japanese Patent Application 2006-47659 filed Feb. 24, 2006 are incorporated herein by reference.

Although the invention has been described above with reference to the embodiments of the invention, the invention is not limited to such embodiments as described above. Various modifications and variations of such embodiments may be carried out by those skilled in the art, in light of the above description.

What is claimed is:

1. A valve actuation device of an internal combustion engine, comprising:

a rocker arm swingably supported by a first supporting shaft, the rocker arm being swung by a torque of a crankshaft of the engine; and two swing cams swingably supported by a second supporting shaft, the two swing cams actuating respective engine valves to make an open/close operation of the same by receiving the swinging movement from the rocker arm, wherein the rocker arm comprises:

a cylindrical base portion through which the first supporting shaft passes;

a first projected end that is provided at a first radially outside part of the cylindrical base portion in the vicinity of one axial end of the cylindrical base portion, the first projected end receiving the torque from the crankshaft for carrying out the pivotal movement of the rocker arm; and two second projected ends that are spaced from each other and provided at a second radially outside part of the cylindrical base portion, the second projected ends actuating the two swing cams when the rocker arm is swung, the first and second radially outside parts being opposite with respect to an axis of the cylindrical base portion.

2. A valve actuation device as claimed in claim 1, further comprising:

a first bearing device that is mounted on a cylinder head to bear the second supporting shaft at a position between the two swing cams.

3. A valve actuation device as claimed in claim 2, in which the first bearing device comprises:

a first bearing bracket having a rounded recess for partially receiving the second supporting shaft; and two bolts securing the first bearing bracket to the cylinder head, wherein one of the bolts is placed at a position that corresponds to a position between the two second projected ends of the rocker arm, and the other one of the bolts is placed at an opposite position of said one bolt with respect to an axis of the second supporting shaft.

4. A valve actuation device as claimed in claim 2, in which the two swing cams are arranged to operatively actuate respective valve lifters of the engine valves, and in which a width of the first bearing device is larger than a thickness of a partition wall of the cylinder head defined between the two valve lifters.

5. A valve actuation device as claimed in claim 2, in which the first supporting shaft is a control shaft that has an eccentric control cam about which the rocker arm swings, the control shaft being turned about its axis by an angle in accordance with an operation condition of the engine, and in which the second supporting shaft is a drive shaft that is driven by the crankshaft.

6. A valve actuation device as claimed in claim 5, further comprising:

a second bearing device that is mounted on the cylinder head to bear the drive shaft at a position other than the position between the two swing cams.

7. A valve actuation device as claimed in claim 5, in which the drive shaft is formed with a drive cam from which a drive power of the drive shaft is transmitted to the first projected end of the rocker arm to swing the rocker arm.

8. A valve actuation device as claimed in claim 5, further comprising:

an eccentric drive cam mounted on the drive shaft; and a ring arm pivotally connected to the first projected end of the rocker arm, the ring arm having a circular opening in which the eccentric drive cam is rotatably received.

9. A valve actuation device as claimed in claim 8, further comprising two link rods, each having one end pivotally connected to one of the two projected ends of the rocker arm and the other end pivotally connected to one of the two swing cams.

10. A valve actuation device as claimed in claim 5, further comprising:

an oval drive cam mounted on the drive shaft;

a roller rotatably connected to the first projected end of the rocker arm, the roller being put on a cam surface of the oval drive cam; and a spring that biases the roller against the cam surface of the oval drive cam.

11. A valve actuation device as claimed in claim 10, further comprising two link rods, each having one end pivotally connected to one of the two second projected ends of the rocker arm and the other end pivotally connected to one of the two swing cams.

12. A valve actuation device as claimed in claim 1, in which each of the swing cams is formed with an insert slot through which a diametrically reduced part of the second supporting shaft is insertable into a circular opening of the swing cam.

13. A valve actuation device as claimed in claim 1, further comprising a lift varying mechanism that controls an angular position of the first supporting shaft to continuously change a position of a swing fulcrum of the rocker arm, thereby to continuously change a lift degree of the engine valves.

14. A valve actuation device as claimed in claim 13, in which the first supporting shaft is formed with an eccentric control cam about which the rocker arm swings.

15. A valve actuation device as claimed in claim 14, in which the lift varying mechanism comprises:

an electric actuator that turns the first supporting shaft about its axis with an electric an electronic controller that controls the electric actuator in accordance with an operation condition of the engine.

16. A valve actuation device as claimed in claim 13, in which the lift varying mechanism is arranged to permit the engine valves to have a lift degree of zero.

17. A valve actuation device of an internal combustion engine, comprising:

a single rocker arm swingably supported by a first supporting shaft, the rocker arm being swung through a single drive cam by a torque of a crankshaft of the engine;

two swing cams swingably supported by a second supporting shaft, the two swing cams actuating respective engine valves to make an open/close operation of the same by receiving the swinging movement from the single rocker arm; and a bearing device that is mounted on a cylinder head to bear the second supporting shaft at a position between the two swing cams.

18. A valve actuation device of an internal combustion engine, comprising:

a control shaft having an eccentric control cam formed thereon, the control shaft being turned about its axis by a predetermined angle;

a rocker arm swingably supported by the eccentric control cam of the control shaft;

a drive shaft driven by a crankshaft of the engine, the drive shaft extending in parallel with the control shaft; and two swing cams swingably supported by the drive shaft, the two swing cams actuating respective engine valves to make an open/close operation of the same when receiving a swinging movement from the rocker arm, wherein the rocker arm comprises:

a cylindrical base portion through which the eccentric control cam of the control shaft passes;

a first projected end that is provided at a first radially outside part of the cylindrical base portion in the vicinity of one axial end of the cylindrical base portion, the first projected end receiving a torque from the crankshaft for carrying out the pivotal movement of the rocker arm; and two second projected ends that are spaced from each other and provided at a second radially outside part of the cylindrical base portion, the second projected ends actuating the two swing cams when the rocker arm is swung, the first and second radially outside parts being opposite with respect to an axis of the cylindrical base portion.

* * * * *